US006971397B1

(12) United States Patent
Knight

(10) Patent No.: US 6,971,397 B1
(45) Date of Patent: Dec. 6, 2005

(54) FACE LIFTING WIG

(75) Inventor: Peggy L. Knight, Fort Lauderdale, FL (US)

(73) Assignee: Peggy Knight Solutions, Inc., Sausalito, CA (US)

( * ) Notice: Subject to any disclaimer, the term of this patent is extended or adjusted under 35 U.S.C. 154(b) by 0 days.

(21) Appl. No.: 09/211,819

(22) Filed: Dec. 15, 1998

(51) Int. Cl.[7] ..... A41G 5/00
(52) U.S. Cl. ..... 132/54
(58) Field of Search ..... 132/53, 54, 58, 132/56, 55, 57.1, 59, 201; 606/204.35

(56) References Cited

U.S. PATENT DOCUMENTS 1,356,112 A * 10/1920 Boisvert ..... 606/204.35
2,438,005 A * 3/1948 Goldman ..... 132/53
3,521,648 A * 7/1970 Capparelli et al. ..... 132/53
3,564,583 A * 2/1971 Klugmann ..... 132/54
3,809,100 A * 5/1974 Megna ..... 132/54
4,239,037 A * 12/1980 Fausone ..... 606/204.35
4,658,841 A * 4/1987 Won ..... 132/53
4,995,379 A * 2/1991 Brooks ..... 606/204.35
5,476,478 A * 12/1995 Jackson ..... 606/204.35
5,555,900 A * 9/1996 Rich ..... 132/53
5,592,957 A * 1/1997 Gazerro et al. ..... 132/53
5,853,009 A * 12/1998 Yu ..... 132/201

* cited by examiner

*Primary Examiner*—Pedro Philogene
(74) *Attorney, Agent, or Firm*—Edward J. Lynch; Duane Morris LLP

(57) ABSTRACT

A face lifting wig comprising a substantially thin hair net structured to be snugly seated over a person's scalp in covering relation thereto and at least one adhesive pad structured to removably adhere to a person's skin so as to retain the skin over a person's face in a lifted position. The hair net includes a first upper portion, a second adjacent lower portion attached to the first upper portion to form a reinforced seam therebetween and a generally resilient border structured to retain the hair net over the person's scalp. The adhesive pads are attached to the bottom surface of the border over the reinforced seam. In use, the hair net is positioned over the user's scalp, the border lifted slightly, the user's skin stretched upwards beneath the border and the border lowered so that the adhesive pads adhere to the user's skin, thereby retaining the skin over the user's face in the lifted position.

19 Claims, 1 Drawing Sheet

FACE LIFTING WIG

BACKGROUND OF THE INVENTION

1. Field of the Invention

The present invention relates to wigs and, more particularly, to a wig which lifts or hyperextends the skin over a person's face.

2. Description of the Related Art

The use of wigs and hairpieces has increased greatly over the past several years. In general, most wigs are comprised of a hair net having a bottom surface structured for placement over the user's head and a top surface having hair thereon.

Over the years several improvements in wig design have been developed. For instance, many wigs include a coating around the outer perimeter of the hair net to create a more stable and resilient structure which will better adhere to a person's head than hair nets without such coating.

The desire to lift the skin over a person's face has also increased greatly over the past several years. Such desire is especially common amongst women and entertainers seeking to change or improve their appearance. Other than surgery, such lifting is accomplished today by placing a thin resilient strip of material, having tape on both ends, over a person's head and lifting or hyperextending the skin on the person's face upward under the tape.

Although these prior art devices are useful for their intended purposes, they are limited to the specific problem and function for which they were designed and are incapable of addressing the problem discovered by applicant and solved by applicant's invention. Specifically, applicant has discovered the need for a wig capable of also achieving the face lifting function. Currently, someone desiring the use of a wig and a face lift, without surgery, will place the face lifting strip over their head and then a conventional wig over the strip. There is nothing in the prior art which teaches or suggests the use of a single structure to accomplish both purposes.

Accordingly, there is still a need in the art for a wig capable of lifting the skin over a person's face. Any such device should include a reinforced seam to place the adhesive so as to reduce stretching of the hair net caused by the skin pulling tangentially on the adhesive, thereby maintaining the structural integrity of the hair net and retaining the skin in the lifted position for a longer period of time. The present invention is particularly suited to overcome those problems which remain in the art in a manner not previously known.

SUMMARY OF THE INVENTION

The present invention is directed towards a new and improved wig which covers a person's scalp and lifts or tightens the person's face comprising a substantially thin hair net structured to be snugly seated over a person's scalp in covering relation thereto and at least one adhesive pad structured to removably adhere to a person's skin so as to retain the skin over a person's face in a lifted position. The hair net includes a first upper portion, a second adjacent lower portion attached to the first upper portion to form a reinforced seam therebetween and a generally resilient border structured to retain the hair net over the person's scalp. The reinforced seam extends from the temple on one side of the person's head to the temple on the opposite side of the person's head. The adhesive pad is attached to the bottom surface of the border over the reinforced seam. In use, the hair net is positioned over the user's scalp, the border lifted slightly, the user's skin stretched upwards beneath the border and the border lowered so that the adhesive pads adhere to the user's skin, thereby retaining the skin over the user's face in the lifted position.

It is an object of the present invention to provide a new and improved wig which has all the advantages of the prior art devices and none of the disadvantages.

It is another object of the present invention to provide a wig which covers a person's scalp and lifts or tightens the person's face.

It is also an object of the present invention to provide such a wig which includes a reinforced seam to maintain the structural integrity of the hair net.

It is a further object of the present invention to provide such a wig which is capable of retaining the skin in the lifted position for a significant period of time.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
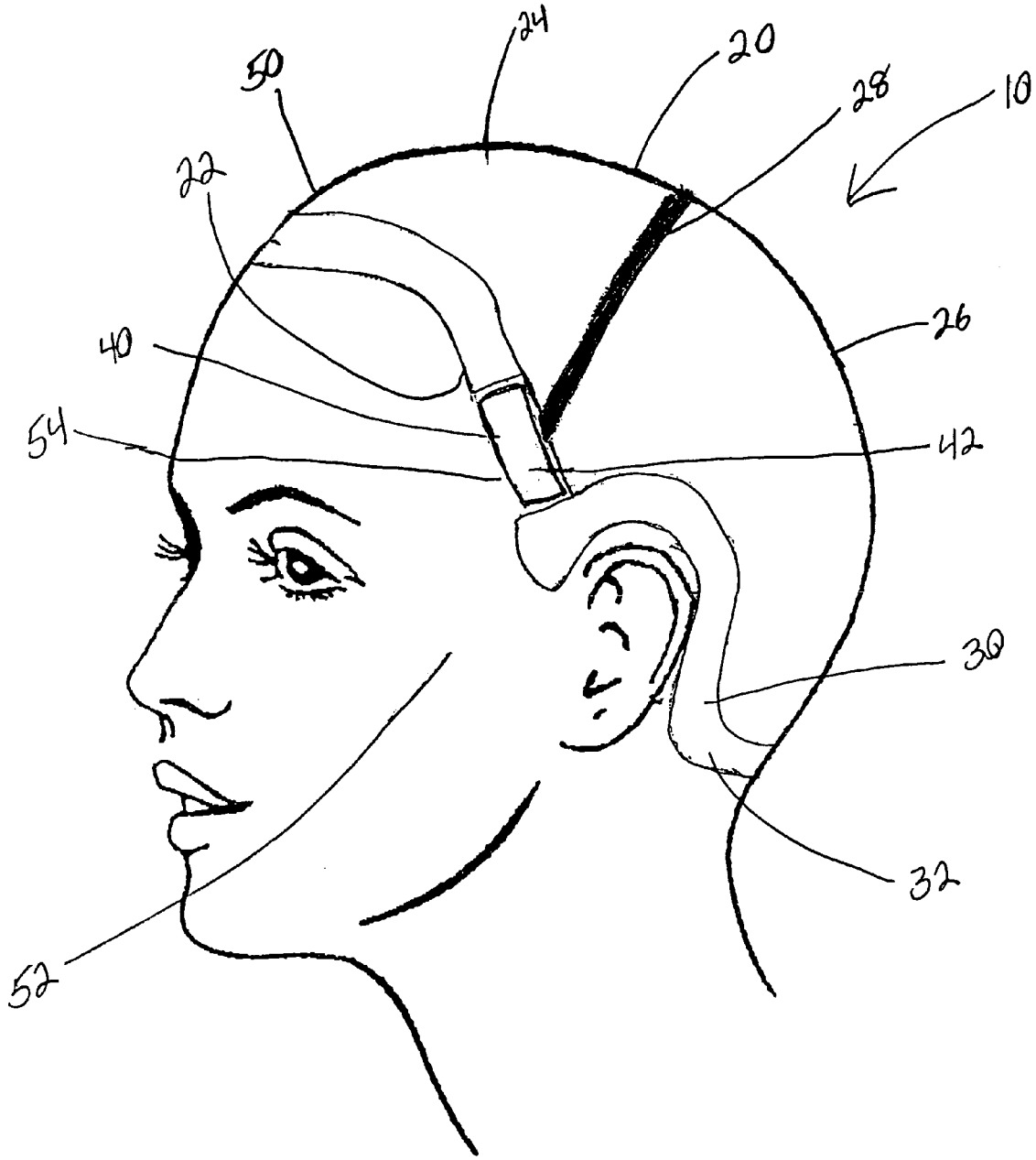
FIG. 1 is a perspective view of the face lifting wig of the present invention, in partial section, seated on a person's head.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

As shown in FIG. 1, the present invention is directed towards a new and improved face lifting wig 10 comprising a substantially thin hair net 20 and at least one adhesive pad 40 attached to a bottom surface 22 of the hair net 20. The hair net 20 is structured to include hair thereon and to be snugly seated over a person's scalp 50 in covering relation thereto.

In the preferred embodiment, the hair net 20 includes a first upper portion 24 and a second adjacent lower portion 26. The first upper portion 24 and second lower portion 26 are sewn or stitched together to form a reinforced seam 28. The reinforced seam 28 provides greater rigidity and stability than caps having a one-piece construction. Such increased rigidity and stability decreases the stretching inherent in one-piece caps, thereby maintaining the overall shape and integrity of the hair net 20.

The first upper portion 24 and second lower portion 26 are preferably structured and disposed so that the reinforced seam 28 extends from the temple 54 on one side of the person's head to the temple (not shown) on the opposite side of the person's head. The reinforced seam 28 is disposed from temple to temple so as such to create an improved anchor point for the adhesive pad 40. Typically, people have a slight recess and no or little hair at the location. Thus, the adhesive pad 40 will more easily adhere to the person's face at that location. It should be appreciated that the hair net 20 may, alternatively, be constructed of three or more portions, thereby increasing the number of reinforced seams 28, or that the location of such reinforced seams 28 may vary as desired.

The hair net 20 further includes a generally resilient border 30 extending around the outer perimeter 32 of the hair net 20. The border is constructed by applying a coating of a resilient sealing material, such as polyurethane, over the outer perimeter 32 of the hair net 20. The coated border 30 is structured to provide greater structural integrity, stability and retention means than the other portions of the hair net 30, thereby enabling the hair net 30 to removably adhere to the person's scalp 50.

The adhesive pads 40 include an upper side 42 attached to the bottom surface 22 of the border 30 over the reinforced seam 28 and an opposite lower side (not shown) having an adhesive substance thereon. The adhesive pads 40 are structured to removably adhere to a person's skin, thereby retaining the skin over the person's face 52 in a lifted position, as well as providing added retention means for the main member 20. By positioning the adhesive pad 40 in the border 30 over the reinforced seam 28, the material bias or stretching inherent in the hair net 20 will be reduced, thereby maintaining the structural integrity of the hair net 20. Thus, the skin over the person's face 52 will remain in the lifted position for a longer length of time. The adhesive pads 40 may be comprised of double sided tape or any other suitable adhesive material known in the art.

In use, the hair net 20 is positioned over the user's scalp 50 so that it is snugly seated thereon. The border 30 of the main member 20 in the location of the adhesive pads 40 is then lifted slightly, the user's skin stretched upwards beneath the border 30 and the border 30 lowered so that the lower side of the adhesive pads 40 adhere to the user's skin, thereby retaining the skin over the user's face 52 in the lifted position.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breath and scope of the claims here appended.

What is claimed is:

1. A face lifting wig comprising:

a. a substantially thin hair net which is structured to be snugly seated over a person's scalp in covering relation thereto, which has at least two sections that are secured together so as to create a reinforced seam therebetween, and which has a generally resilient border extending around an outer perimeter of said hair net that is configured to retain said hair net over said person's scalp; and b. at least one skin retaining element at the resilient border at an end of the reinforced seam to retain skin over a person's face in a lifted position.

2. A face lifting wig as recited in claim 1 wherein the hair net sections are secured to one another by stitching.

3. A face lifting wig as recited in claim 1 wherein the skin retaining element is an adhesive pad.

4. A face lifting wig as recited in claim 3 wherein the reinforced seam extends from a temple on one side of said person's scalp to a temple on an opposite side of said person's scalp.

5. A face lifting wig as recited in claim 4 wherein a first adhesive pad is positioned at a first end of the reinforced seam and a second adhesive pad is positioned at an opposite second end of the reinforced seams.

6. A face lifting wig as recited in claim 1 wherein the resilient border is constructed of a coating of resilient material on the outer perimeter of said hair net.

7. A face lifting wig as recited in claim 6 wherein said resilient material is polyurethane.

8. A face lifting wig comprising:

a. a substantially thin hair net which is structured to snugly seat over a person's scalp in covering relation thereto, which has at least two sections secured together so as to create a reinforced seam therebetween, and which has a generally resilient border extending around an outer perimeter of said hair net structured to retain said hair net over said person's scalp; and b. at least one adhesive pad attached to a bottom surface of said border of said hair net at an end of the reinforced seam, which is configured to retain the skin over a person's face in a lifted position.

9. A face lifting wig as recited in claim 8 wherein the hair net sections are secured to one another by stitching.

10. A face lifting wig as recited in claim 8 wherein a reinforced seam extends from a temple on one side of said person's scalp to a temple on an opposite side of said person's scalp.

11. A face lifting wig as recited in claim 10 wherein a first adhesive pad is positioned at a first end of the reinforced seam and a second adhesive pad is positioned at a second end of the reinforced seam.

12. A face lifting wig as recited in claim 8 wherein the resilient border has a coating of resilient material.

13. A face lifting wig as recited in claim 12 wherein said resilient material is polyurethane.

14. A face lifting wig comprising:

a. a substantially thin hair net which is configured to snugly seat over a person's scalp in covering relation thereto, which has at least two sections secured to one another so as to create a reinforced seam therebetween, and which has a generally resilient border extending around an outer perimeter of said hair net configured to retain said hair net over said person's scalp;

b. at least one reinforced seam extending from a temple on one side of said person's scalp to a temple on an opposite side of said person's scalp; and c. at least one adhesive pad attached to a bottom surface of said border of said hair which is configured to retain skin over a person's face in a lifted position.

15. A face lifting wig as recited in claim 14 wherein the hair net sections are secured to one another by stitching.

16. A face lifting wig as recited in claim 14 wherein a first adhesive pad is positioned at a first end of a reinforced seam and a second adhesive pad is positioned at a second end of the reinforced seam.

17. A face lifting wig as recited in claim 14 wherein the resilient border has a coating of resilient material.

18. A face lifting wig as recited in claim 17 wherein said resilient material is polyurethane.

19. A face lifting wig as recited in claim 14 wherein said adhesive pad is double sided tape.

* * * * *